US008888459B2

(12) United States Patent
Noble

(10) Patent No.: US 8,888,459 B2
(45) Date of Patent: Nov. 18, 2014

(54) COUPLED BLADE PLATFORMS AND METHODS OF SEALING

(75) Inventor: Patrick Daniel Noble, Greenville, SC (US)

(73) Assignee: General Electric Company, Schenectady, NY (US)

( * ) Notice: Subject to any disclaimer, the term of this patent is extended or adjusted under 35 U.S.C. 154(b) by 578 days.

(21) Appl. No.: 13/215,522

(22) Filed: Aug. 23, 2011

(65) Prior Publication Data

US 2013/0052020 A1 Feb. 28, 2013

(51) Int. Cl.

| | |
|---|---|
| ***F01D 5/30*** | (2006.01) |
| ***F01D 5/22*** | (2006.01) |
| ***F01D 11/00*** | (2006.01) |

(52) U.S. Cl.

CPC ..... *F01D 5/22* (2013.01); *F01D 5/3007* (2013.01); *F01D 11/006* (2013.01); *F05D 2240/80* (2013.01)

USPC ..... 416/193 A

(58) Field of Classification Search

CPC ..... F01D 5/30; F01D 5/3007; F01D 5/32; F01D 5/323; F01D 5/326; F01D 5/16; F04D 29/322; F04D 29/668

USPC ..... 416/212, 193 A, 220 R, 219 R, 210 R, 416/196 R, 210 A, 500; 29/889.2, 889, 29/889.1, 889.21

See application file for complete search history.

(56) References Cited

U.S. PATENT DOCUMENTS 1,073,623 A * 9/1913 Owen ..... 416/191
1,423,466 A * 7/1922 Snyder ..... 416/191
2,220,918 A * 11/1940 Smith ..... 416/191
2,405,146 A * 8/1946 Huber ..... 416/212 R
2,510,734 A * 6/1950 Bodger ..... 416/190
2,632,396 A * 3/1953 Koskinen ..... 416/191
2,669,383 A * 2/1954 Purvis et al. ..... 416/219 R
2,772,854 A * 12/1956 Anxionnaz ..... 416/190
2,936,155 A * 5/1960 Howell et al. ..... 416/134 R
3,014,695 A * 12/1961 Rankin et al. ..... 416/220 R
3,034,764 A * 5/1962 Davis et al. ..... 416/210 R
3,104,093 A * 9/1963 Craig et al. ..... 416/210 R
3,107,897 A * 10/1963 Judge et al. ..... 416/191
3,137,478 A * 6/1964 Farrell ..... 416/220 R
3,182,955 A * 5/1965 Hyde ..... 416/96 R
3,185,441 A * 5/1965 Reuter ..... 416/182
3,640,640 A * 2/1972 Palfreyman et al. ..... 416/2
3,702,222 A * 11/1972 Bernales ..... 16/212 R (Continued)

*Primary Examiner* — Nathaniel Wiehe
*Assistant Examiner* — Eldon Brockman
(74) *Attorney, Agent, or Firm* — Dority & Manning, P.A.

(57) ABSTRACT

An array of rotor blades is provided. The array includes a rotor disk defining a plurality of slots. A first rotor blade that includes a first platform between a first airfoil and a first shank portion is coupled with a first slot of the rotor disk via the first shank portion. The first rotor blade further includes a pair of oppositely disposed flanges positioned between the first platform and the first shank portion and extending beyond a longitudinal side edge defined by the first platform. A second rotor blade, that includes a second platform defining a pair of oppositely disposed overhang lips and positioned between a second airfoil and a second shank portion, is coupled with a second slot of the rotor disk via the second shank portion. The second rotor blade is positioned adjacent to the first rotor blade such that one of the overhang lips of the second platform is positioned over one of the flanges of the first rotor blade. Methods are also generally provided for installing rotor blades onto a rotor disk.

13 Claims, 5 Drawing Sheets

(56) References Cited

U.S. PATENT DOCUMENTS

| | | | | | |
|---|---|---|---|---|---|
| 3,761,200 | A * | 9/1973 | Gardiner | 416/220 R |
| 3,801,221 | A * | 4/1974 | Zlotek | 416/214 R |
| 3,834,831 | A * | 9/1974 | Mitchell | 416/95 |
| 3,867,069 | A * | 2/1975 | Bussell | 416/212 R |
| 3,923,420 | A * | 12/1975 | Chifos | 416/190 |
| 3,985,465 | A * | 10/1976 | Sheldon et al. | 415/189 |
| 4,029,436 | A * | 6/1977 | Shoup et al. | 416/193 A |
| 4,080,101 | A * | 3/1978 | Zlotek | 416/216 |
| 4,093,399 | A * | 6/1978 | Glenn | 416/95 |
| 4,243,360 | A * | 1/1981 | Wright | 416/191 |
| 4,422,827 | A * | 12/1983 | Buxe et al. | 416/193 A |
| 4,426,191 | A * | 1/1984 | Brodell et al. | 415/189 |
| 4,465,432 | A * | 8/1984 | Mandet et al. | 416/215 |
| 4,580,946 | A * | 4/1986 | Bobo | 416/193 A |
| 4,583,914 | A * | 4/1986 | Craig et al. | 416/204 A |
| 4,685,863 | A * | 8/1987 | McLean | 416/95 |
| 4,710,097 | A * | 12/1987 | Tinti | 415/138 |
| 4,778,342 | A * | 10/1988 | Conlow | 416/220 R |
| 4,813,850 | A * | 3/1989 | Partington | 416/219 R |
| 4,818,182 | A * | 4/1989 | Bouru | 416/215 |
| 4,840,539 | A * | 6/1989 | Bourcier et al. | 416/191 |
| 5,044,886 | A * | 9/1991 | Stenneler | 416/215 |
| 5,174,715 | A * | 12/1992 | Martin | 415/209.4 |
| 5,277,548 | A * | 1/1994 | Klein et al. | 416/193 A |
| 5,429,479 | A * | 7/1995 | Cordier | 415/209.3 |
| 5,435,694 | A * | 7/1995 | Kray et al. | 416/219 R |
| 6,152,698 | A * | 11/2000 | Gregg et al. | 416/215 |
| 6,196,794 | B1 * | 3/2001 | Matsumoto | 415/191 |
| 6,331,097 | B1 * | 12/2001 | Jendrix | 416/96 R |
| 6,375,429 | B1 * | 4/2002 | Halila et al. | 416/193 A |
| 6,425,738 | B1 * | 7/2002 | Shaw | 415/208.1 |
| 6,439,844 | B1 * | 8/2002 | Turnquist et al. | 415/173.3 |
| 6,503,051 | B2 * | 1/2003 | Predmore | 415/135 |
| 6,568,908 | B2 * | 5/2003 | Namura et al. | 416/190 |
| 6,579,065 | B2 | 6/2003 | Scott et al. | |
| 6,632,070 | B1 * | 10/2003 | Tiemann | 415/191 |
| 6,821,087 | B2 * | 11/2004 | Matsumoto et al. | 415/191 |
| 6,877,956 | B2 * | 4/2005 | Gazzillo et al. | 416/191 |
| 6,893,215 | B2 * | 5/2005 | Kuwabara et al. | 415/139 |
| 6,910,854 | B2 * | 6/2005 | Joslin | 415/139 |
| 7,104,759 | B2 * | 9/2006 | Tipton et al. | 416/219 R |
| 7,334,983 | B2 * | 2/2008 | Alvanos et al. | 415/115 |
| 7,415,763 | B2 * | 8/2008 | Miosga et al. | 29/889.21 |
| 7,416,393 | B2 * | 8/2008 | Richter | 416/213 R |
| 7,600,972 | B2 | 10/2009 | Benjamin et al. | |
| 7,722,320 | B2 * | 5/2010 | Matsumoto et al. | 415/191 |
| 7,874,791 | B2 * | 1/2011 | Ferber et al. | 415/137 |
| 7,878,763 | B2 | 2/2011 | Keith et al. | |
| 7,976,281 | B2 * | 7/2011 | Keith et al. | 416/193 A |
| 8,083,475 | B2 * | 12/2011 | Bulgrin et al. | 415/173.7 |
| 8,092,165 | B2 * | 1/2012 | Bouchard et al. | 415/209.2 |
| 8,206,116 | B2 * | 6/2012 | Pickens et al. | 416/215 |
| 8,435,007 | B2 * | 5/2013 | Morrison | 416/193 A |
| 2002/0071764 | A1 * | 6/2002 | Turnquist et al. | 415/173.3 |
| 2003/0185673 | A1 * | 10/2003 | Matsumoto et al. | 415/159 |
| 2005/0220624 | A1 * | 10/2005 | Tipton et al. | 416/219 R |
| 2006/0257259 | A1 * | 11/2006 | Blatchford et al. | 416/219 R |
| 2008/0232969 | A1 * | 9/2008 | Brault et al. | 416/219 R |
| 2008/0286106 | A1 * | 11/2008 | Keith et al. | 416/193 A |
| 2008/0286109 | A1 * | 11/2008 | Keith et al. | 416/239 |
| 2010/0189562 | A1 * | 7/2010 | Blanchard et al. | 416/219 R |
| 2011/0052397 | A1 * | 3/2011 | Kusters et al. | 416/205 |
| 2011/0110784 | A1 * | 5/2011 | DeMania et al. | 416/219 R |
| 2011/0142652 | A1 * | 6/2011 | Bock | 416/183 |
| 2011/0293430 | A1 * | 12/2011 | Jan | 416/219 R |
| 2012/0045337 | A1 * | 2/2012 | Fedor et al. | 416/193 A |
| 2012/0244002 | A1 * | 9/2012 | Meka | 416/219 R |
| 2013/0022469 | A1 * | 1/2013 | McCaffrey | 416/220 R |
| 2013/0266447 | A1 * | 10/2013 | Evans et al. | 416/191 |

* cited by examiner

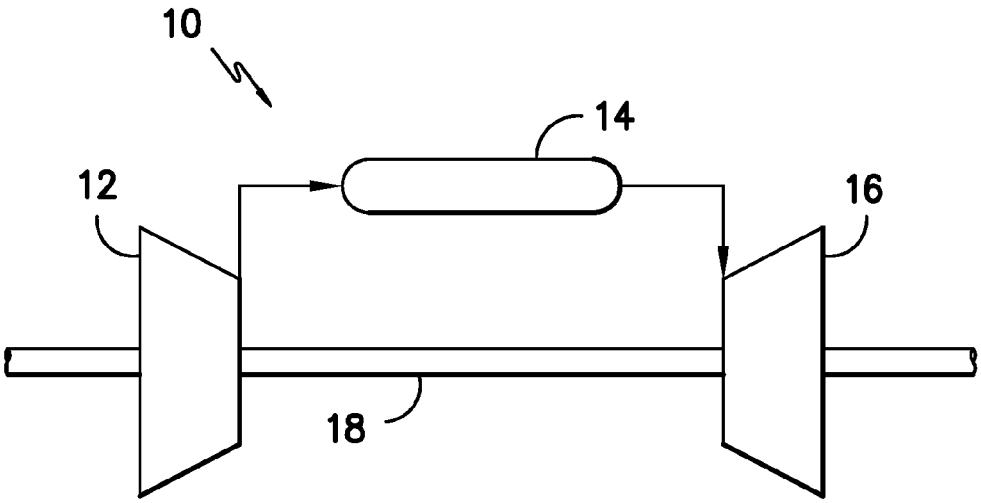
FIG. –1–
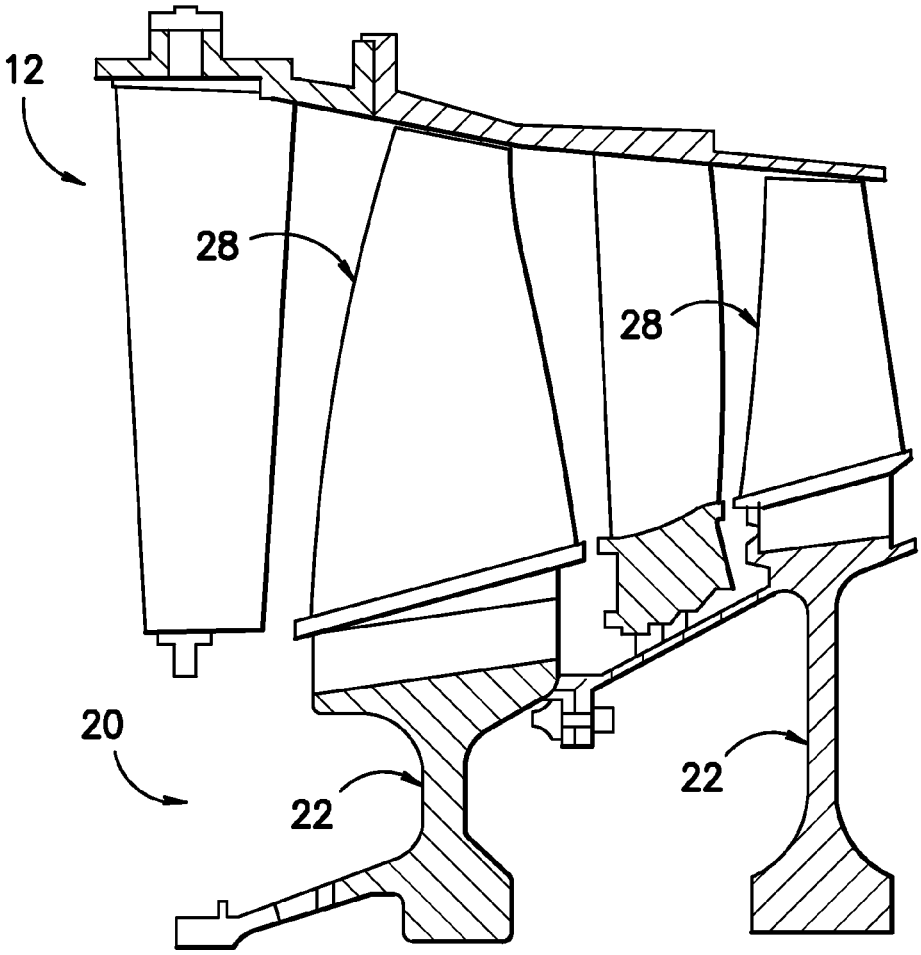
FIG. –2–

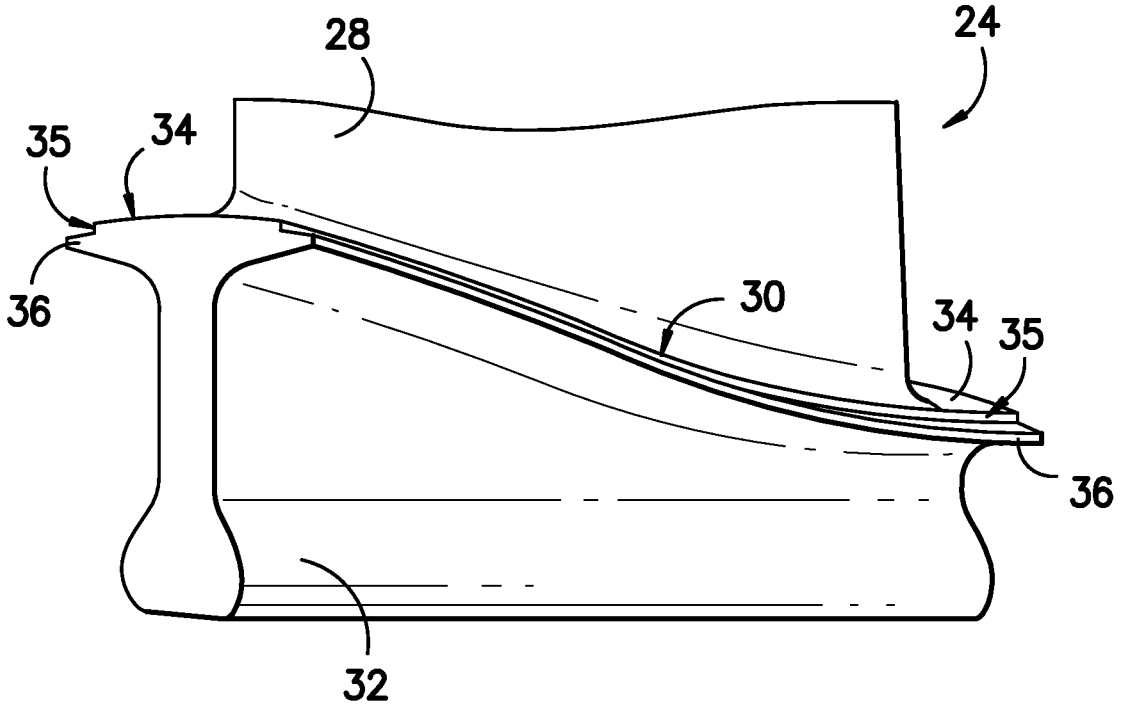
FIG. –4–
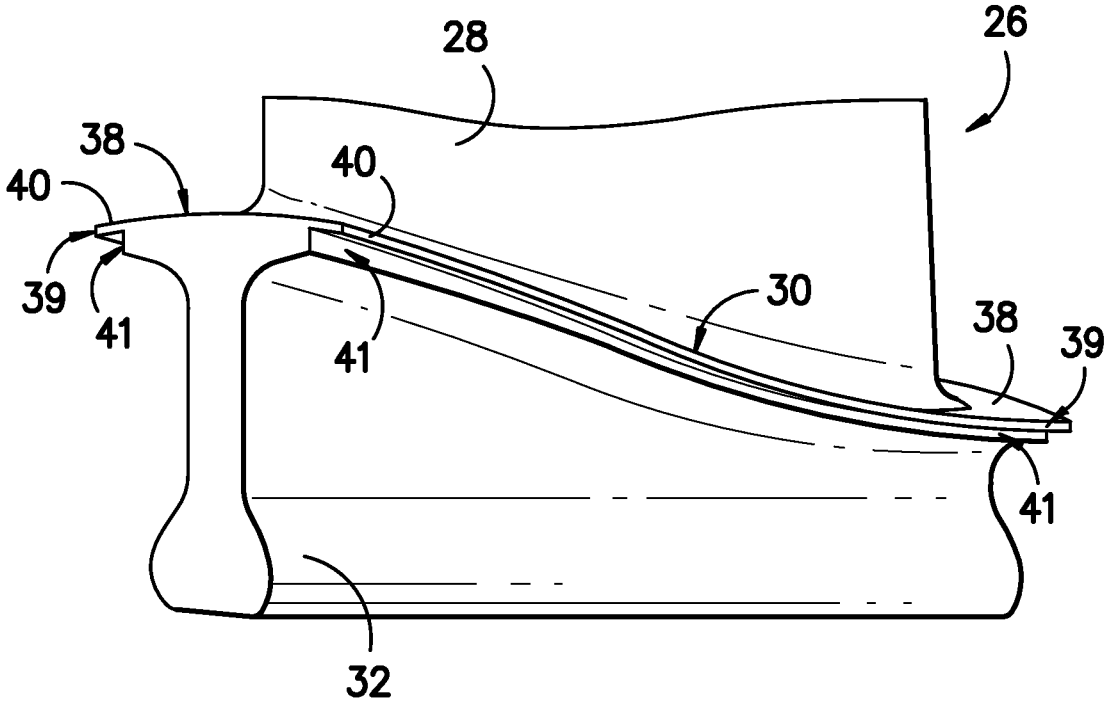
FIG. –5–

COUPLED BLADE PLATFORMS AND METHODS OF SEALING

FIELD OF THE INVENTION

The subject matter disclosed herein relates generally to blade platforms in turbines, and more specifically to the coupling of adjacent blade platforms in turbines.

BACKGROUND OF THE INVENTION

Gas turbine systems are widely utilized in fields such as power generation. A conventional gas turbine system includes a compressor, a combustor, and a turbine. Typical gas turbine engines include a rotor assembly having a row of rotor blades that extend radially outward from a platform positioned between an airfoil portion of the blade and a dovetail portion of the blade. The dovetail couples each rotor blade to the rotor disk such that a radial clearance may be defined between each rotor blade platform and the rotor disk.

The rotor blades are circumferentially spaced such that a gap is defined between adjacent rotor blades. More specifically, a gap extends between each pair of adjacent rotor blade platforms. Because the platforms define a portion of the gas flow path through the engine, during engine operation fluid may flow through the gaps, resulting in blade air losses and decreased engine performance. Adjacent blade platform may be coupled together according to a traditional ship-lapping design, with each platform having the identical platform shape: one side with an upward facing undercut and the opposite side with a downward facing undercut.

However, when using a curved blade platform, the use of traditional ship-lapping designs can be problematic. For example, when installed one at a time, the final blade platform installed onto the rotor can have only one ship-lapped joint.

As such, a need exists for a design coupling of adjacent blade platforms, particularly curved blade platforms.

BRIEF DESCRIPTION OF THE INVENTION

Aspects and advantages of the invention will be set forth in part in the following description, or may be obvious from the description, or may be learned through practice of the invention.

An array of rotor blades is generally provided, along with the configurations of the rotor blades themselves. The array generally includes a rotor disk defining a plurality of slots. A first rotor blade that includes a first platform between a first airfoil and a first shank portion is coupled with a first slot of the rotor disk via the first shank portion. The first rotor blade further includes a pair of oppositely disposed flanges positioned between the first platform and the first shank portion and extending beyond a longitudinal side edge defined by the first platform. A second rotor blade, that includes a second platform defining a pair of oppositely disposed overhang lips and positioned between a second airfoil and a second shank portion, is coupled with a second slot of the rotor disk via the second shank portion. The second rotor blade is positioned adjacent to the first rotor blade such that one of the overhang lips of the second platform is positioned over one of the flanges of the first rotor blade.

Methods are also generally provided for installing rotor blades onto a rotor disk. Generally, a first shank portion of a first rotor blade is inserted into a first slot defined in the rotor disk. The first rotor blade includes a first platform between a first airfoil and the first shank portion, and further includes a pair of oppositely disposed flanges positioned between the first platform and the first shank portion and extending beyond a longitudinal side edge defined by the first platform. A second shank portion of a second rotor blade is inserted into a second slot defined in the rotor disk. The second rotor blade includes a second platform defining a pair of oppositely disposed overhang lips and positioned between a second airfoil and the second shank portion. The second rotor blade is positioned adjacent to the first rotor blade such that one of the overhang lips of the second platform is positioned over one of the flanges of the first rotor blade.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 illustrates a schematic diagram of one embodiment of a gas turbine;

FIG. 2 illustrates a schematic diagram of one embodiment of a compressor in the gas turbine of FIG. 1;

FIG. 4 illustrates an a perspective view of a first rotor blade;

FIG. 5 illustrates an a perspective view of a second rotor blade; and

DETAILED DESCRIPTION OF THE INVENTION

Figure 3:
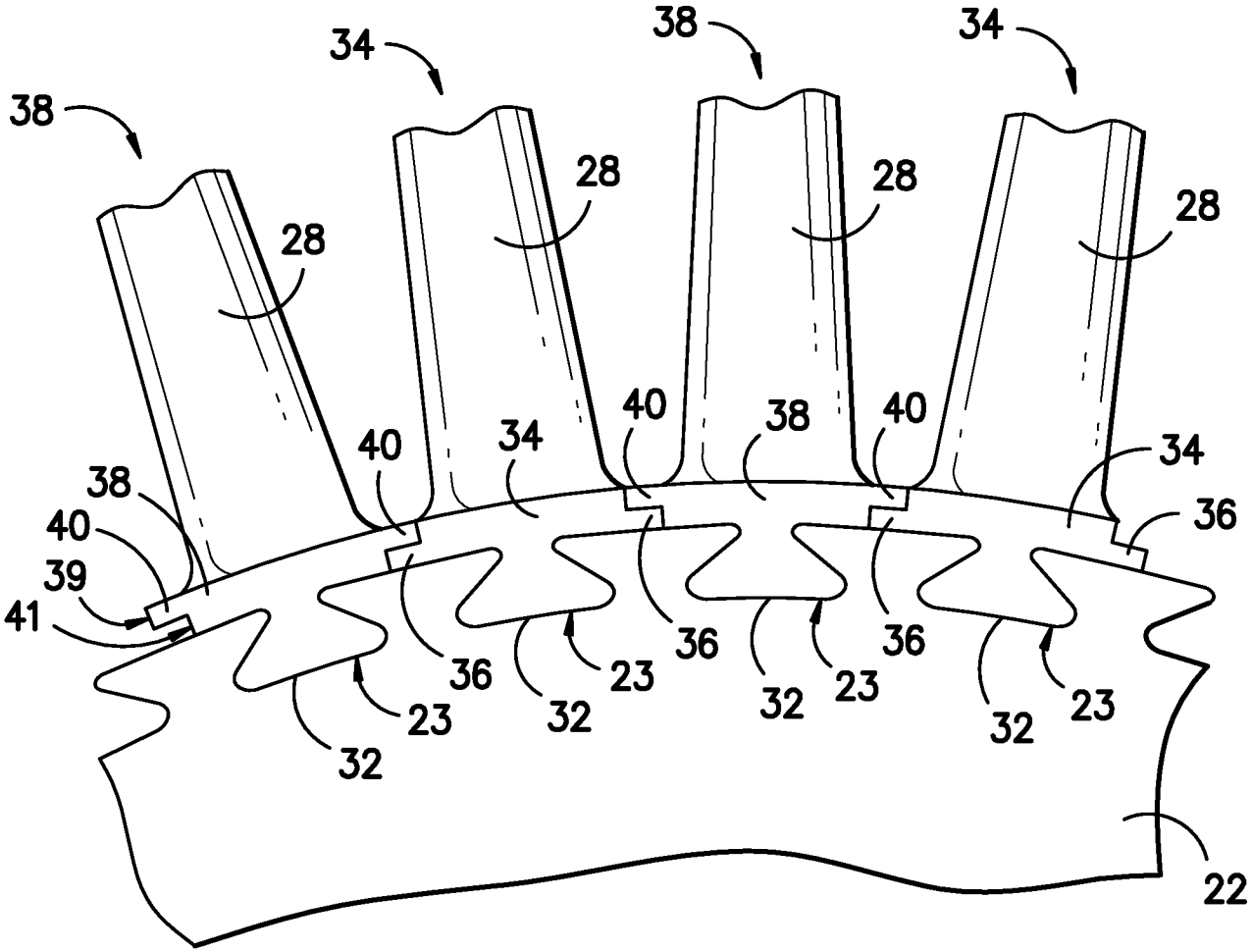
FIG. 3 illustrates an array of first and second rotor blades positioned in an alternating configuration and secured to a rotor disk.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a turbine system 10. While the turbine system 10 described herein may generally be a gas turbine system, it should be understood that the turbine system 10 of the present disclosure is not limited to gas turbine systems, and that any suitable turbine system, including but not limited to a steam turbine system, is within the scope and spirit of the present disclosure. Generally, the system may include a compressor 12, a combustor section 14, and a turbine 16. The compressor 12 and turbine 16 may be coupled by a shaft 18. The shaft 18 may be a single shaft or a plurality of shaft segments coupled together to form shaft 18.

Various components of the compressor 12 of the turbine system 10 are shown in FIG. 2. For example, a rotor 20 of the compressor 12 may include a plurality of rotor disks 22. A plurality of airfoils 28 may be disposed in an annular array about each rotor disk 22, and may be attached to the rotor disk 22 as discussed below. It should be understood, however, that the present disclosure is not limited to use in rotor disks 22 in the compressor 12 of a turbine system 10. Rather, the airfoils 28 may be utilized in conjunction with any suitable section of the turbine system 10 (e.g., the compressor 12 and/or the turbine section 16).

Referring to FIG. 3, first rotor blades 24 and second rotor blades 26 are shown positioned in an alternating configuration around the rotor disk 22. Each of the first rotor blades 24 and the second rotor blades 26 include an airfoil 28 extending radially outwardly in an annular array about the rotor disk 22 and a shank portion 32 (e.g., a dovetail) extending radially inwardly to secure the rotor blade 24 to the rotor disk 22 (e.g., configured to mate with the slot 23 defined in the rotor disk). The airfoil 28 may generally include an airfoil base 30 disposed at the platform 34, 38 and an airfoil tip 31 disposed opposite the airfoil base 30. Thus, the airfoil tip 31 may generally define the radially outermost portion of the rotor blades 24, 26. Additionally, the rotor blades 24, 26 may also include an airfoil cooling circuit (not shown) extending radially outwardly from the shank portion 32 for flowing a cooling medium, such as air, water, steam or any other suitable fluid, throughout the airfoil 28. The airfoil cooling circuit may generally have any suitable configuration known in the art.

As shown in FIG. 3, two configurations of rotor blades 24, 26 are shown: a first rotor blade 24 and a second rotor blade 26. The first rotor blade 24 defines a first platform 34 positioned between the airfoil 28 and the shank portion 32. Likewise, the second rotor blade 26 defines a second platform 38 positioned between the airfoil 28 and the shank portion 32. The platforms 34, 38 generally serve as the radially inward boundary for the hot gases of combustion flowing through the gas turbine 10.

As shown, each of the first rotor blade 24 and the second rotor blade 26 defines a platform 34, 38 (respectively) having different configuration.

Referring to FIGS. 4 and 5, an exemplary first rotor blade 24 and the second rotor blade 26 are shown, respectively. In these embodiments, both the first platform 34 of the first rotor blade 24 and the second platform 38 of the second rotor blade 26 generally define a curved shape. However, the platforms 34, 38 can have a substantially planar configuration in other embodiments.

The first platform 34 of the first rotor blade 24 shown in FIG. 4 defines a pair of oppositely disposed longitudinal side edges 35 that generally extend along the entire length of the first platform 34. The first rotor blade 24 includes a pair of flanges 36 extending outwardly on either side of the first rotor blade 24 such that each flange 36 extends beyond its respective longitudinal side edge 35 leaving the longitudinal side edges 35 exposed along each side of the first platform 34. In one particular embodiment, each flange 36 extends beyond its respective longitudinal side edge 35 for the longitudinal side edge's entire length.

The second platform 38 of the second rotor blade 26 shown in FIG. 5 defines a pair of oppositely disposed longitudinal side edges 39. Each side edge 39 defines an overhang lip 40 extending outwardly from the second rotor blade 26. Thus, a recessed edge 41 is disposed below each overhang lip 40. As shown, the top surface of each overhang lip 40 is substantially flush with the exposed surface of the second platform 38. Thus, the overhang lips 40 generally act as an extension of the second platform 38 along each longitudinal side edge 39.

As shown in FIG. 3, the second rotor blade 26 is positioned adjacent to the first rotor blade 24 such that one of the overhang lips 40 of the second platform 38 is positioned over one of the flanges 36 of the first rotor blade 24. Thus, the flange 36 of the first rotor blade 24 can be configured to mate with the overhang lip 40 extending outwardly from the second platform 38 when the first and second rotor blades 24, 26 are placed adjacent to each other. As shown, the overhang lip 40 of the second platform 38 extends over the flange 36 of the first platform 34. Thus, the recessed edge 41 defined under the overhand lip 40 of the second platform 38 of the second rotor blade 26 can mate with the flange 36 and side edge 35 of the first platform 34 of the first rotor blade 24.

The configurations of the first platform 34 of the first rotor blade 24 and the second platform 38 of the second rotor blade 26 are such that the first rotor blade 24 and the second rotor blade 26 can be positioned in an alternating configuration to mate the side edge of the platforms 34, 38 with the side edge of the platform 34, 38 of the adjacent bucket. As such, the buckets can be positioned in an -A-B-A-B-configuration (where A represents the first rotor blade 24 and B represents the second rotor blade 26) to form an array 21 around the entire circumference of the rotor disk 22. Thus, the array 21 of rotor blades can include a plurality of the first rotor blades 24 and a plurality of second rotor blades 26 alternatively arranged around the rotor disk 22 such that each first rotor blade 24 is adjacently positioned between two second rotor blades 26 and each second rotor blade 26 is adjacently positioned between two first rotor blades 24.

Figure 6:
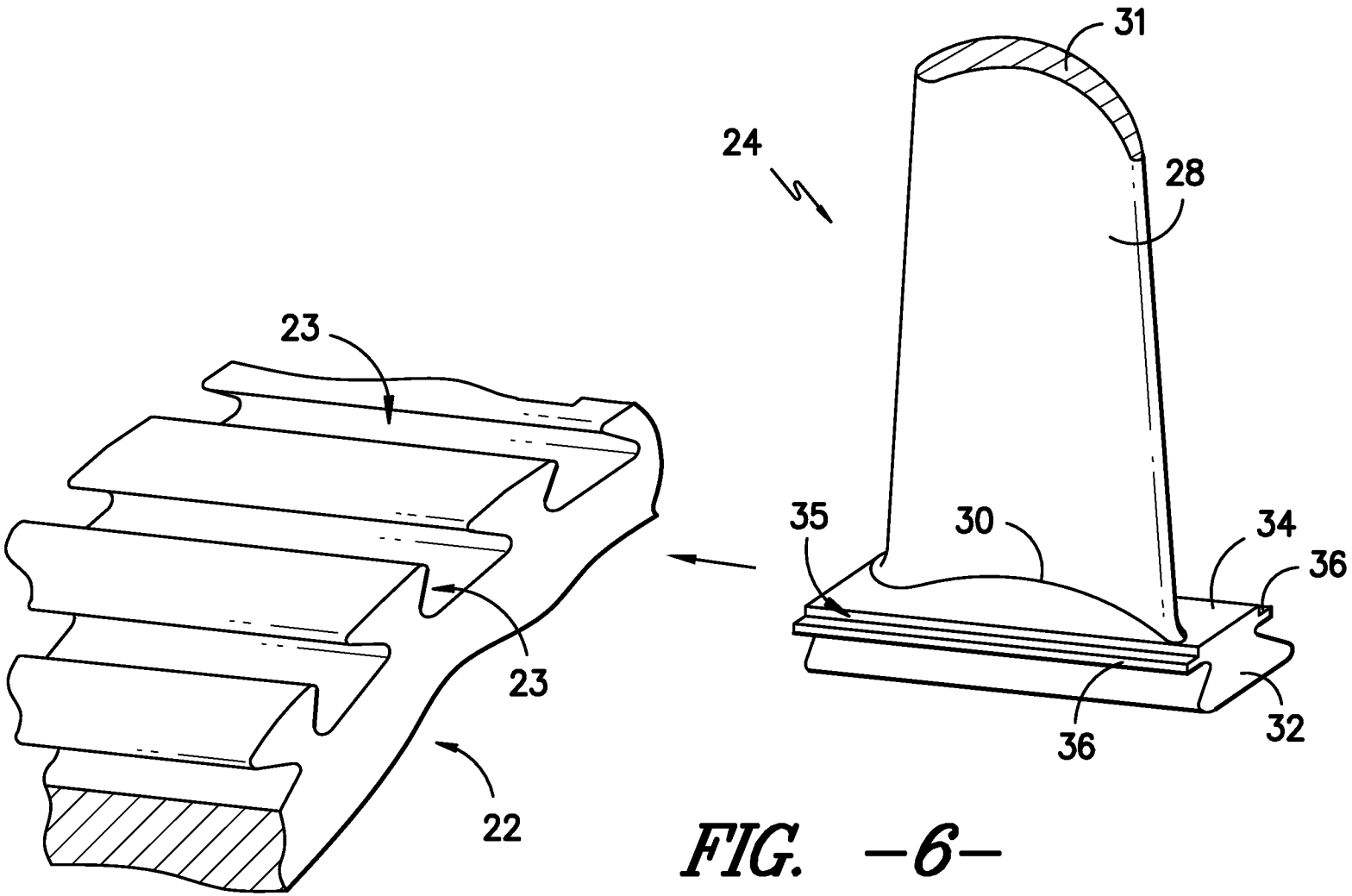
FIG. 6 illustrates an exemplary step of securing a first rotor blade to the rotor disk.
Figure 7:
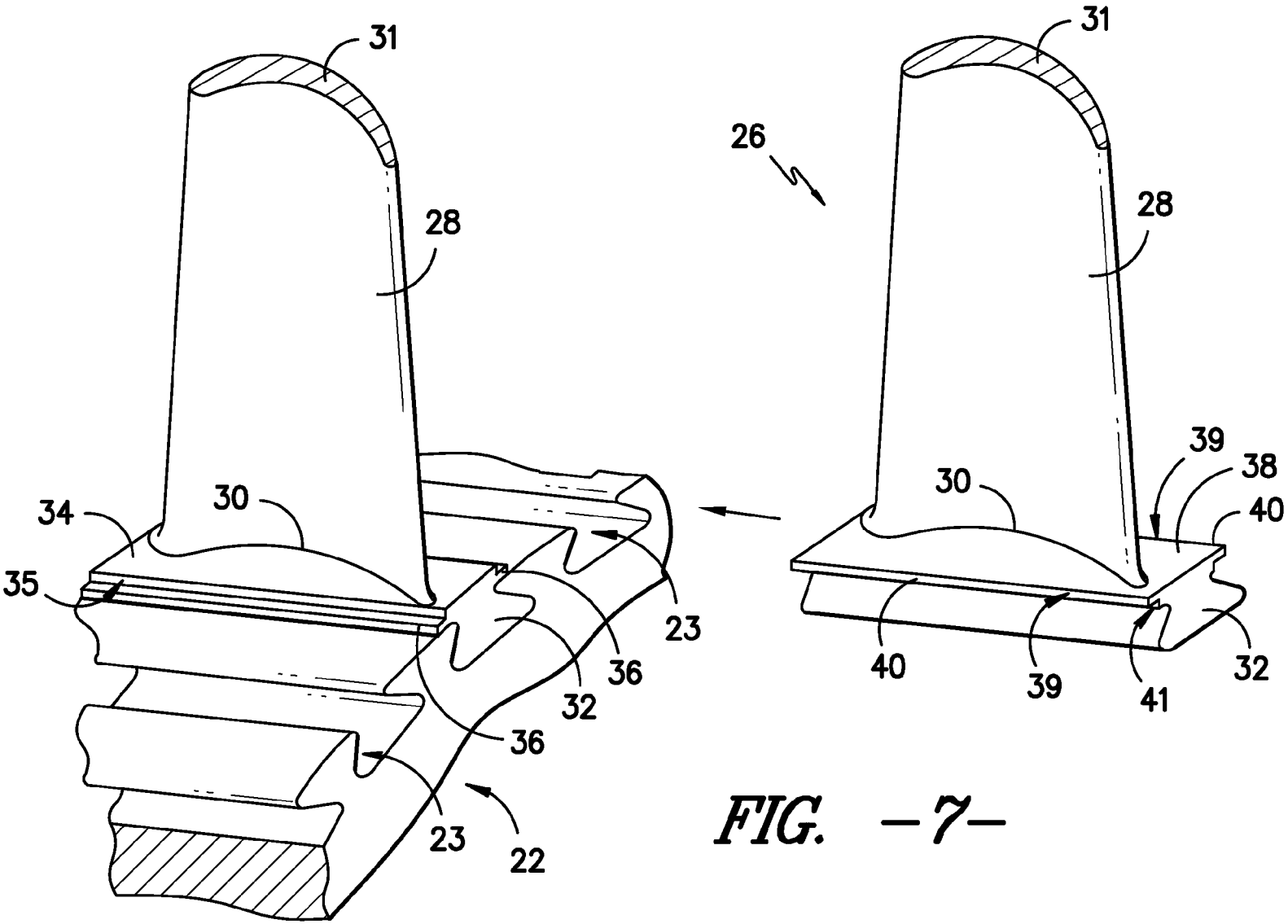
FIG. 7 illustrates an exemplary step of securing a second rotor blade to the rotor disk.

FIGS. 6 and 7 sequentially show an exemplary method for installing rotor blades onto a rotor disk 22. Generally, FIG. 6 shows the first shank portion 32 of the first rotor blade 24 being inserted into a first slot 23 defined in the rotor disk 22. FIG. 7 shows the second shank portion 32 of a second rotor blade 26 is inserted into a second slot 23 defined in the rotor disk 22 adjacent to the first slot 23. The second rotor blade 26 is positioned adjacent to the first rotor blade 24 such that one of the overhang lips 40 of the second platform 38 is positioned over one of the flanges 36 of the first rotor blade 24. According to this method, a plurality of first rotor blades 24 and second rotor blades 26 can be inserted into slots 23 defined in the rotor disk 22 such that first rotor blades 24 and the second rotor blades 26 are arranged in an alternating configuration (i.e., each first rotor blade 24 is adjacently positioned between two second rotor blades 26 and each second rotor blade 26 is adjacently positioned between two first rotor blades 24).

In one embodiment, the first rotor blades 24 are inserted into every other slot 23 in the rotor disk 22 prior to inserting the second rotor blades 26 into the remaining slots 23 in the rotor disk 22. This particular order of inserting the first rotor blades 24 prior to inserting the second rotor blades 26 can be particularly useful when the platforms 34, 38 defined a curved surface.

Though the first platform 34 and the second platform 38 can be mated together to inhibit air flow therebetween, there may be instances where a gap is intentionally left between the platforms 34, 38 to allow air flow therebetween and therethrough. In one particular embodiment, the top surface of each overhang lip can be substantially flush with an exposed surface of the second platform, whether or not a gap exists therebetween.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An array of rotor blades, comprising:

a rotor disk defining a plurality of slots;

a first rotor blade comprising a first platform between a first airfoil and a first shank portion, wherein the first rotor blade further comprises a pair of oppositely disposed flanges, each flange being positioned between the first platform and the first shank portion and extending beyond a longitudinal side edge defined by the first platform, and wherein the first shank portion is coupled with a first slot of the rotor disk;

a second rotor blade comprising a second platform defining a pair of oppositely disposed overhang lips and positioned between a second airfoil and a second shank portion, wherein the second shank portion is coupled with a second slot of the rotor disk, wherein the second rotor blade is positioned adjacent to the first rotor blade such that one of the overhang lips of the second platform is positioned over one of the flanges of the first rotor blade, and wherein a top surface of the first platform and a top surface of the second platform are flush, and a bottom surface of the first platform and a bottom surface of the second platform are flush and in contact with an outer surface of the rotor disk.

2. The array of rotor blades as in claim 1, Wherein each overhang lip extends beyond a recessed edge between the second platform and the second shank portion.

3. The array of rotor blades as in claim 1, further comprising:

a plurality of the first rotor blades and a plurality of second rotor blades, wherein the first rotor blades and the second rotor blades are alternatively arranged around the rotor disk such that each first rotor blade is adjacently positioned between two second rotor blades and each second rotor blade is adjacently positioned between two first rotor blades.

4. The array of rotor blades as in claim 1, wherein the first platform and the second platform define a curved surface.

5. The array of rotor blades as in claim 1, wherein the first platform and the second platform are mated together to inhibit air flow therebetween.

6. The array of rotor blades as in claim 1, wherein each flange extends beyond its respective longitudinal side edge for the longitudinal side edge's entire length.

7. The array of rotor blades as in claim 1, wherein a top surface of each overhang lip is substantially flush with an exposed surface of the second platform.

8. A method of installing rotor blades onto a rotor disk, the method comprising:

inserting first shank portions of a plurality of first rotor blades into a plurality of first slots defined in the rotor disk, wherein each first rotor blade comprises a first platform between a first airfoil and the first shank portion, wherein each first rotor blade further comprises a pair of oppositely disposed flanges, each flange being positioned between the first platform and the first shank portion and extending beyond a longitudinal side edge defined by the first platform; and inserting second shank portions of a plurality of second rotor blades into a plurality of second slots defined in the rotor disk, wherein each second rotor blade comprises a second platform defining a pair of oppositely disposed overhang lips and positioned between a second airfoil and the second shank portion, wherein each second rotor blade is positioned adjacent to one of the plurality of first rotor blades such that one of the overhang lips of the second platform is positioned over one of the flanges of the first rotor blade, wherein the first rotor blades and the second rotor blades are arranged in an alternating configuration such that each first rotor blade adjacently positioned between two second rotor blades and each second rotor blade is adjacently positioned between two first rotor blades; and wherein the first rotor blades are inserted into every other slot in the rotor disk prior to inserting the second rotor blades into the remaining slots in the rotor disk.

9. The method as in claim 8, wherein each overhang lip extends beyond a recessed edge between the second platform and the second shank portion.

10. The method as in claim 8, wherein the first platform and the second platform define a curved surface.

11. The method as in claim 8, wherein the first platform and the second platform are mated together to inhibit air flow therebetween.

12. The method as in claim 8, wherein each flange extends beyond its respective longitudinal side edge for the longitudinal side edge's entire length.

13. The method as in claim 8, wherein a top surface of each overhang lip is substantially flush with an exposed surface of the second platform.

* * * * *